United States Patent [19]

Foster

[11] Patent Number: 4,728,207

[45] Date of Patent: Mar. 1, 1988

[54] RIBBON CARTRIDGE WITH PIVOTABLE RIBBON GUIDE ARMS

[75] Inventor: Harold S. Foster, Fremont, Calif.

[73] Assignee: Xerox Corporation, Stamford, Conn.

[21] Appl. No.: 900,102

[22] Filed: Aug. 25, 1986

[51] Int. Cl.[4] ..... B41J 32/00; B41J 35/08

[52] U.S. Cl. ..... 400/248; 400/208; 400/217.1; 400/234

[58] Field of Search ..... 400/248, 208, 211, 234, 400/215–217.1

[56] References Cited

U.S. PATENT DOCUMENTS

| | | | |
|---|---|---|---|
| 2,941,646 | 6/1960 | D'onofrio et al. | 400/248 |
| 3,900,099 | 8/1975 | Hengelhanpt | 400/248 |
| 4,003,460 | 1/1977 | Gray et al. | 400/248 |
| 4,397,575 | 8/1983 | Aldrich | 400/208 |
| 4,402,621 | 9/1983 | Abel, Jr. et al. | 400/208 |
| 4,402,622 | 9/1983 | Sugiura | 400/212 |
| 4,423,973 | 1/1984 | Theilen | 400/248 |
| 4,645,363 | 2/1987 | Andersson | 400/248 |

FOREIGN PATENT DOCUMENTS

| | | | |
|---|---|---|---|
| 118238 | 9/1984 | European Pat. Off. | 400/248 |
| 3110952 | 10/1982 | Fed. Rep. of Germany | 400/248 |
| 194883 | 11/1984 | Japan | 400/248 |

OTHER PUBLICATIONS

Sendelweck et al., "Ribbon Lift Guide Motion", IBM Technical Disclosure Bulletin, vol. 13, No. 12, pp. 3671, 5–71.

*Primary Examiner*—William Pieprz

*Attorney, Agent, or Firm*—Serge Abend

[57] ABSTRACT

A ribbon cartridge having a pair of movable arms extending outwardly from the body, over which the ribbon passes on its transit from an internal ribbon supply to an internal used ribbon storage. Each of the arms is supported for movement about an oblique axis which moves the active marking portion of the ribbon so that the path traversed by one edge is equal in length to the path traversed by the opposite edge.

4 Claims, 15 Drawing Figures

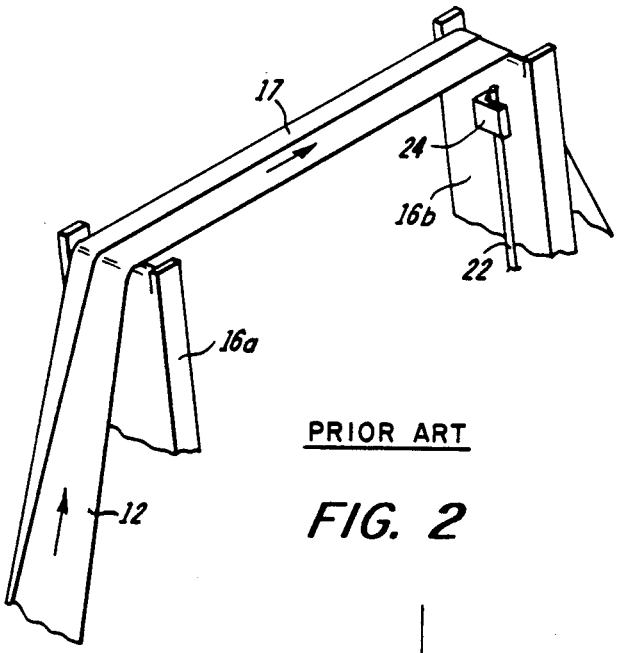
PRIOR ART
FIG. 2
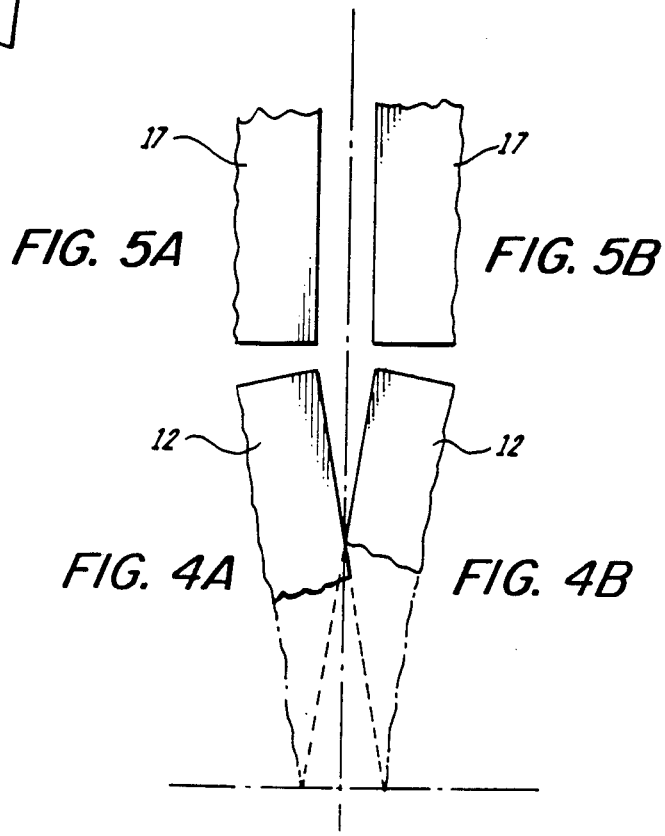

RIBBON CARTRIDGE WITH PIVOTABLE RIBBON GUIDE ARMS

FIELD OF THE INVENTION

This invention relates to a ribbon cartridge having movable ribbon guide arms pivotably mounted relative to the cartridge housing to move the active marking region of the ribbon vertically with respect to the platen.

BACKGROUND OF THE INVENTION

In typewriter printing applications there are several instances in which the active marking region of the ribbon is to be raised and lowered with respect to the platen: (1) when it is necessary for the operator to be able to see the typed print line which is obscured from view during the printing action; (2) to shift a multicolored ribbon to permit print color selection; and (3) to obtain optimum utilization of ribbon material by impacting the ribbon at vertically distinct positions thereon prior to advancing the ribbon laterally. To this end interactive keyboard printer devices have been provided with various mechanisms for raising and lowering the ribbon.

Conventionally the ribbon cartridge is mounted upon a platform in the machine and suitable drives and linkages are included to oscillate the entire platform and cartridge in timed relation to character impacts. This solution requires the rapid movement of cumulatively heavy elements, creating momentum and inertia problems. As a result, expensive motors and controls must be provided in order to achieve accurate movements.

One successful solution to minimizing the momentum and inertia problems associated with the vertical movement of the active marking region of the ribbon has been the design of ribbon cartridges with pivotable ribbon support arms. In embodiments of this type, only the arms, which carry the active region of the ribbon therebetween, need be vertically oscillated or vibrated. The much lower mass can be more rapidly moved with significantly less expensive mechanisms and the generation of objectionable noise.

Shifting of the cartridge arms creates a major problem because the active marking portion of the ribbon is moved relative to its supply and take-up portions about a pivot axis which is parallel to the active marking portion. This results in the generation of uneven stresses in the ribbon due to unequal lengths of travel of its edges. Usually there will be one taut edge and one slack edge, a condition which results in the folding over of the slack edge, a decrease in the usable ribbon width causing incomplete typed characters and eventual fouling of the ribbon transport.

U.S. Pat. No. 4,397,575 (Aldrich) and U.S. Pat. No. 4,402,621 (Abell, Jr. et al) disclose ribbon cartridges with vibrating ribbon guide arms. In each of these, edge tensions develop, caused by the different lengths of ribbon paths of the top and bottom edges as the arms are shifted. Fold over can be a consequence of these shifting configurations.

An attempt to solve the problem is suggested in U.S. Pat. No. 4,423,973 wherein a ribbon raising and lowering device is disclosed in which the pivot arm has a long radius from the pivot point to the ends of the movable guide arms defining the active marking region. Ribbon tension is reduced, by diminishing the variation in ribbon length between the top and bottom edges, but still is present.

Usually motion imparting means need only push the arms upwardly since downward biasing means provided within the cartridge (as in U.S. Pat. No. 4,402,621) acts to normally hold the arms in one direction. Thus, in its free state, out of the machine, the bottom edge of the ribbon normally is slack. In this condition, any advancement of the ribbon will cause the ribbon to slide toward the slack edge and to fold. An adverse condition occurs upon removing the cartridge from its shipping container. The ribbon in the active marking region will be a little loose, and single strike ribbon will probably will have some ink voids where handling has occurred. Any ink voids will result in incomplete printing. Immediately prior to introduction into the machine, it is usually necessary for the operator to manually advance the ribbon. Operator instructions, packaged with the cartridge, caution the operator to lie the cartridge on a flat surface, so as to straighten the pivotable arms, prior to manually advancing the ribbon, so that a taut, completely inked, portion extends across the active marking region. This will prevent fold-over because, in this condition, both edges will follow a path of the same length. However, since operators do not always follow instructions, fold-over often occurs during the manual advancing and subsequent machine advancement continues to fold the ribbon and it eventually fouls itself.

SUMMARY OF THE INVENTION

Accordingly it is an object of this invention to provide a ribbon cartridge having pivotable arms which will raise and lower the ribbon but will cause no slack whatever to exist in either edge, regardless of the position of the arms.

It is another object of the present invention to provide such a ribbon cartridge wherein the top and bottom edges follow paths of equal lengths.

The present invention may be carried out, in one form, by providing a ribbon cartridge including a body cavity within which are stored a supply of ribbon and used ribbon, the cartridge having a pair of movable arms extending outwardly from the body, over which the ribbon passes on its transit from the supply region to the used ribbon collection region. Each of the arms is supported for movement about an oblique axis which moves the ribbon so that the path traversed by one edge is equal in length to the path traversed by the opposite edge.

BRIEF DESCRIPTION OF DRAWINGS

Other objects and further features and advantages of this invention will be apparent from the following, more particular, description considered together with the accompanying drawings wherein:

FIG. 2 is an isometric view of a portion of the ribbon cartridge of FIG. 1 showing ribbon fold-over, FIGS. 4A,4B,5A and 5B are sectional views taken along lines 4A—4A and 5A—5A of FIG. 3A, and 4B—4B and 5B—5B of FIG. 3B.

DETAILED DESCRIPTION OF THE ILLUSTRATED EMBODIMENTS

Figure 1:
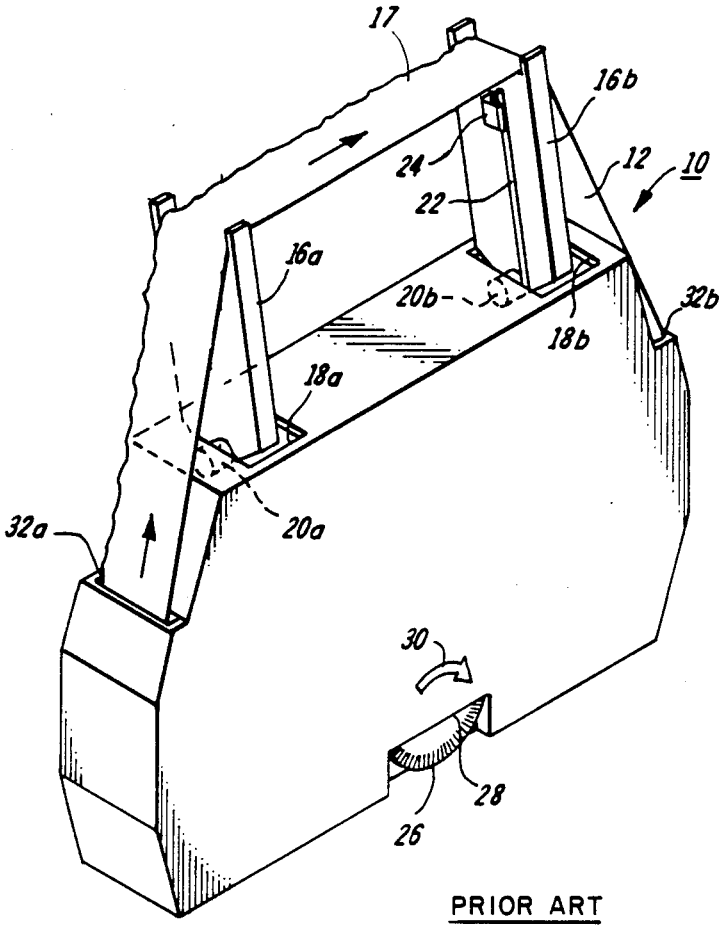
FIG. 1 is an isometric view of a conventional ribbon cartridge.
Figure 3A:
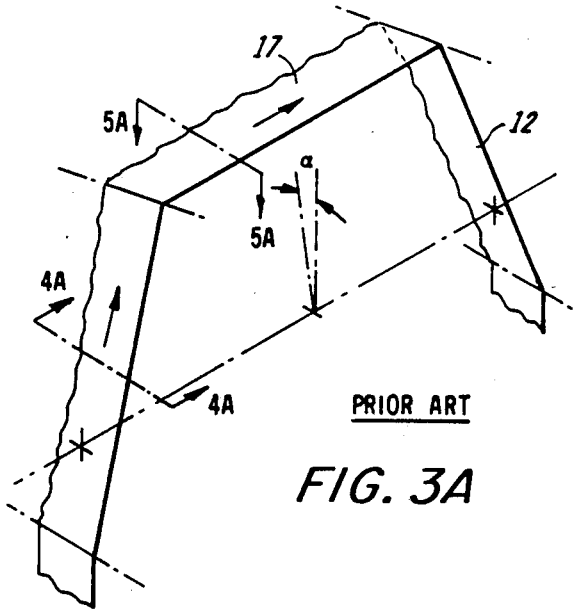
FIGS. 3A and 3B are isometric schematic views of the ribbon of the FIG. 1 cartridge in the two shifted positions, showing the slackened ribbon edges.
Figure 3B:
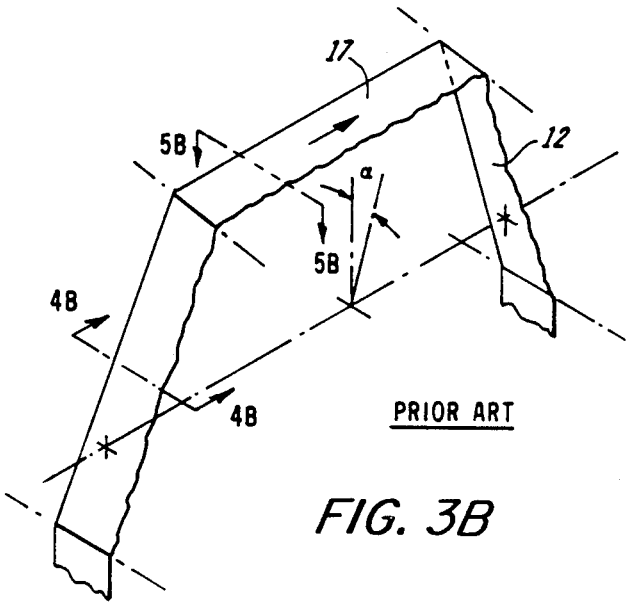

Referring now to the drawings, there is disclosed in FIGS. 1 through 5 the known prior art ribbon cartridge 10 which stores and supports a ribbon 12. The ribbon storage may comprise conventional supply and take-up spools as are used with single strike and multi-strike ribbons or, in the case of reusable cloth ribbons, may randomly stuff the used ribbon once it has been used. The cartridge comprises a main body 14 and a pair of pivotable arms 16*a* and 16*b*. The outer ends of arms 16 support the active marking region 17 of ribbon 12 and the inner ends of arms 16 pass through openings 18*a* and 18*b* in the body and terminate in pivot pins 20*a* and 20*b* which are supported in suitable bearings. Both pivots are in axial alignment with one another, their axes being parallel to the active marking region 17 which, in turn, will be parallel to the axis of the platen when the cartridge is mounted in a printer. Each arm is biased (into the page, as illustrated-downward, when mounted in the printer) by a spring 22 having one end anchored within the body and its other end acting upon a formation 24 on each arm. A manual advancing knob 26, protrudes from an opening 28 in the body. When it is rotated in the direction of imprinted arrow 30, it rotates an internal driver for advancing the ribbon 12 along a path extending from any suitable supply (not shown) out of the body 14 through opening 32*a*, over the outer ends of pivotable arms 16*a* and 16*b* and back into the body through another opening 32*b* to any suitable take-up (not shown). Movement of the ribbon is in the direction indicated by the arrows thereon. When mounted in the printer, a suitable driving element on the printer couples with the driver to provide mechanical advancement for the ribbon.

The width of the ribbon is made to be large enough to allow imprinting of two vertically displaced characters. In the printer, the arms 16*a* and 16*b* are normally biased downwardly. During the printing operation, a character is first impacted upon an upper portion of the ribbon. Then the arms are moved up by a suitable mechanism and a second character is impacted upon a lower portion of the ribbon, below the first character. Finally, the ribbon is advanced laterally one increment and these actions are repeated. The increment of advancement may be an entire character (single strike) or a portion of a character (multi-strike).

It can be seen in FIGS. 1,3,4 and 5 that the shifted ribbon will have one slack edge and one taut edge, depending on the position of the arms. When the arms are deflected by an angle $\alpha$ from their central position, the outer end of the pivot arms traverse an arc about the pivot pin and the path of travel of one ribbon edge will be lengthened, while the path of travel of the opposite edge is shortened. The edge following the shortened path will be slack. If the ribbon is advanced with a slack edge, as is the case during incorrect manual advancement, that edge will fold over on itself as shown in FIG. 2. The slack edge condition also results in difficulty of properly mounting the ribbon cartridge on the printer, since that edge can more easily get caught in the print-wheel spokes.

The sectional views 4A, 4B, 5A and 5B have been drawn to show the orientation of the ribbon 12 when the arms are shifted downward (A) and upward (B) from a central, neutral, position. It can be seen that as the arms tilt, one of the edges is taut and the other is slack.

Figure 6:
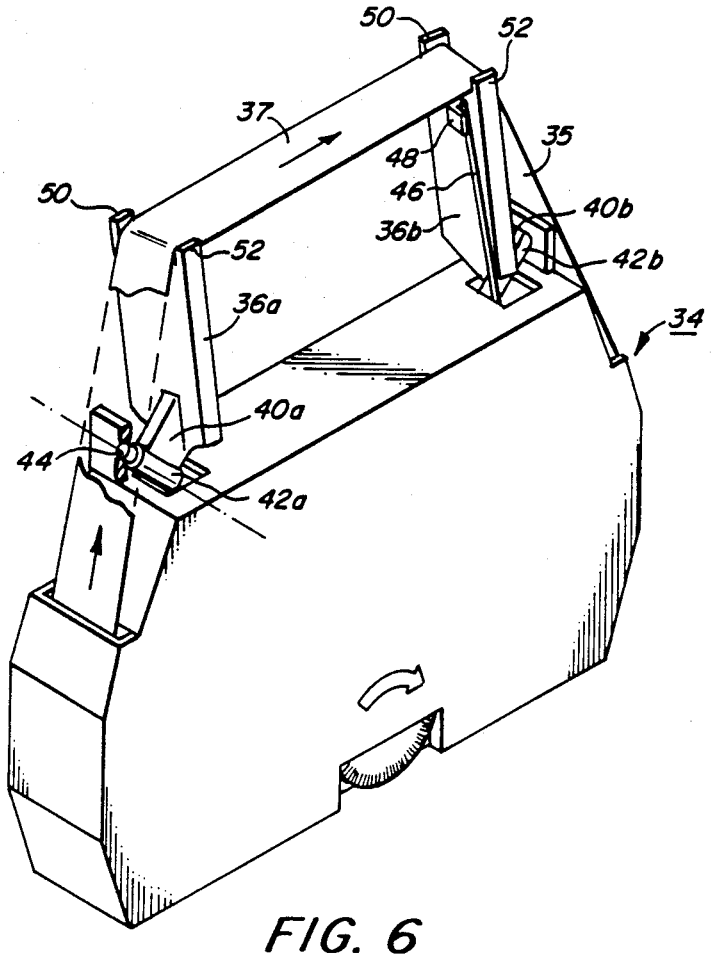
FIG. 6 is an isometric view of the ribbon cartridge of the present invention.
Figure 7A:
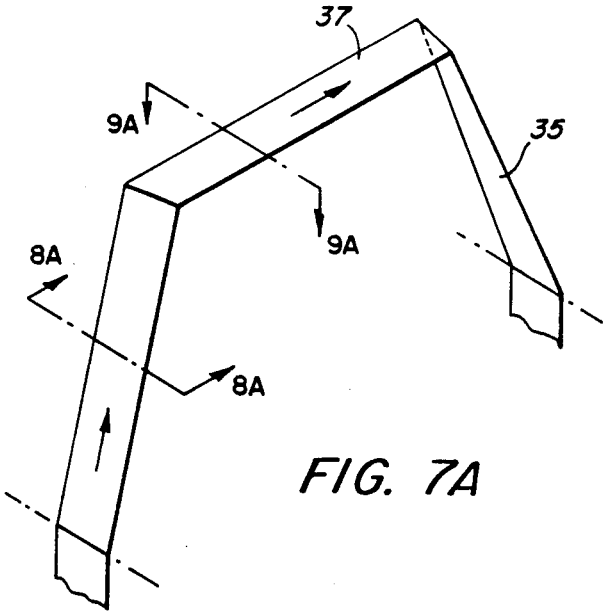
FIGS. 7A and 7B are isometric schematic views of the ribbon of the present invention showing the taut ribbon edges in the two shifted positions.
Figure 7B:
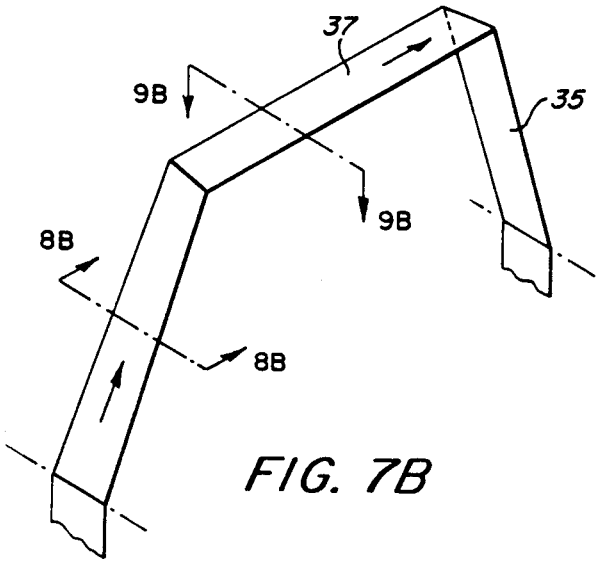
Figures 8A, 8B, 9A, 9B:
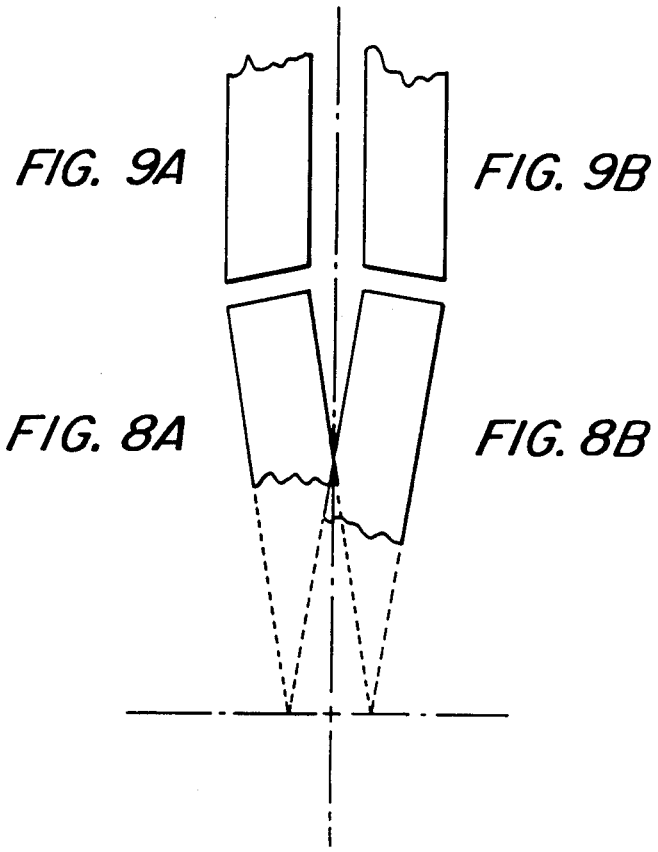
FIGS. 8A,9A,8B and 9B are sectional views taken along lines 8A—8A and 9A—9A of FIG. 7A, and 8B—8B and 9B—9B of FIG. 7B

In the ribbon cartridge 34 of the present invention, as illustrated in FIGS. 6, 7, 8 and 9, neither one of the edges of ribbon 35 will be slack, in any position of the arms 36*a* and 36*b*. The body portion of cartridge 34 is basically the same as cartridge 10, illustrated in FIG. 1. The difference, from which the improved performance is derived, resides in the mounting arrangement for its pivotable arms 36*a* and 36*b*. Each arm pivots on an axis disposed at an angle in the range of 40° to 50° relative to the active marking region 37 of the ribbon, rather than on an axis parallel to the active region. A 45° angle has been found to be optimum. Although it should be understood that this mounting arrangement may be effected in different ways, in the form shown, each arm is provided with an offset brace 40*a*, 40*b* which supports a pivot pin 42*a*, 42*b* mounted for rotation in suitable bearings 44, formed in the body. As is the case in the cartridge of FIG. 1, the arms are biased in the downward direction (into the page, as viewed in the drawing) by spring 46 having one end anchored in the body and the opposite end held against formations 48.

The unique oblique pivoting arrangement of this invention causes the ends of the arms to move in a compound manner. As they tilt downwardly under the influence of spring 46, the lower edge 50 is splayed outwardly and the upper edge 52 is toed inwardly. Conversely, when the arms are moved upwardly, under the influence of the shifting mechanism in the printer, the upper edge 52 of each arm will be splayed outwardly and the lower edge 50 of each arm will be toed inwardly. In this manner, the arms urge each of the ribbon edges to follow paths of equal length. As the arms are deflected by the angle $\alpha$ from their central position, the path to be traversed by the lower edge is lengthened by the same amount that the path to be traversed by the upper edge is reduced.

The sectional views 8A, 8B, 9A and 9B have been drawn to show the orientation of the ribbon 35 when the arms are shifted downward (A) and upward (B) from a central, neutral, position. It can be seen that as the arms tilt, they also swing out so that both of the edges are taut.

The improved ribbon cartridge, shown and described, achieves equal ribbon paths and tension edge-to-edge so that no slack condition is ever present and no ribbon folding will occur. This has been accomplished by providing oblique pivot axes for the pivotable arms. It should be understood that the present disclosure has been made only by way of example, and that numerous changes in details of construction and the combination and arrangement of parts may be resorted to without departing from the true spirit and scope of the invention as hereinafter claimed.

What is claimed:

1. A ribbon cartridge for use in a printing machine, said cartridge including a body within which is housed a supply of ribbon and used ribbon, an opening in said body through which a portion of said ribbon exits said cartridge from said supply and an opening in said body through which said used ribbon reenters said cartridge, and a pair of ribbon support arms secured to said body for pivotable movement, each arm having one end over which said portion of said ribbon is guided to define an active marking region between the two edges of said ribbon, the cartridge being characterized by comprising:

pivot means on the opposite ends of said support arms and said support arms for compound movement, said pivot means being oblique to an axis extending between said arms at said opposite ends, so that as said one ends move in a plane generally normal to the plane to said body they also swing toward and away from each other so as to define paths of movement of equal length for said two edges of said ribbon.

2. The ribbon cartridge as defined in claim 1 wherein said pivot means comprises a pivot axis disposed at an angle in the range of 40° to 50° to the plane of said active marking region.

3. The ribbon cartridge as defined in claim 2 further including biasing means for urging said support arms in one direction of movement.

4. The ribbon cartridge as defined in claim 1 wherein as said one ends move, the path of one edge of said ribbon within said active marking region is increased as the path of said other edge is increased.

* * * * *